United States Patent [19]

Eriksson

[11] 3,937,125

[45] Feb. 10, 1976

[54] DEVICE FOR LOADING AN ARTILLERY PIECE

[75] Inventor: Carl-Erik Eriksson, Karlskoga, Sweden

[73] Assignee: AB Bofors, Bofors, Sweden

[22] Filed: Mar. 25, 1974

[21] Appl. No.: 454,498

[30] Foreign Application Priority Data

Apr. 2, 1973 Sweden ..... 73045882

[52] U.S. Cl. ..... 89/45

[51] Int. Cl.[2] ..... F41F 9/02

[58] Field of Search ..... 89/33 A, 33 B, 45, 46, 89/47

[56] References Cited

UNITED STATES PATENTS

| | | | |
|---|---|---|---|
| 653,071 | 7/1900 | Dawson et al. | 89/46 |
| 847,917 | 3/1907 | Dawson et al. | 89/46 |
| 1,302,520 | 5/1919 | Dawson et al. | 89/45 |
| 1,753,850 | 4/1930 | Coursevlles | 89/45 |

FOREIGN PATENTS OR APPLICATIONS

| | | | |
|---|---|---|---|
| 372,847 | 4/1907 | France | 89/45 |

*Primary Examiner*—Stephen C. Bentley
*Attorney, Agent, or Firm*—Elliott I. Pollock

[57] ABSTRACT

An apparatus for loading an artillery piece, particularly a heavy artillery piece, includes a loading tray connected to the elevating mass of the artillery piece and mounted for selective displacement between a loading position and a ramming position. A loading table is provided for supporting a plurality of shells in side-by-side relation to one another, and an elongated loading trough separate from the table and tray is disposed therebetween. Operator means are provided to cause a shell to roll from the table into the trough so that the weight of the shell causes the trough to pivot into an inclination which corresponds to that of the loading tray, and the trough is then laterally tilted to roll the shell out of said trough and onto the loading tray when the tray is in its loading position, whereafter the loading tray is displaced to its ramming position.

7 Claims, 6 Drawing Figures

DEVICE FOR LOADING AN ARTILLERY PIECE

The present invention relates to a device for loading an artillery piece, particularly a heavy field artillery piece, utilizing a loading tray that can be swung between a loading position and a ramming position, which is connected with the elevating mass of the piece, a shell and a cartridge case then being conveyed separately for ramming simultaneously.

When loading field artillery pieces, the various operations involved in the loading are carried out manually, to a great extent. Particularly in the case of heavy artillery, the manual loading work is heavy and time-consuming, which imposes a certain limitation on both the rate of fire and the capability of maintaining fire. Further, the crew must be behind and in the immediate vicinity of the piece when ramming takes place, which is very unsatisfactory from the point of view of safety.

The purpose of the invention is, through mechanization of the loading procedure, to increase the rate of fire and the capability of maintaining fire of artillery pieces, and to reduce the risks of injuries in connection with the loading.

The loading procedure according to the invention is mainly characterized in that the shell is rolled laterally from a loading table connected to the traversing parts of the piece down into a loading trough arranged at the loading table and separate from the loading tray, which is supported coaxially on the elevating trunnions of the piece via a balancing device which, when the loading trough is empty, holds the side of the trough facing the loading table on a level with the table, that the loading trough by the weight of the shell and counteracting the balancing device is pressed downwards at its rear end against a stop arranged on the elevating mass which determines an inclined position of the loading trough in which the loading trough will be set parallel to the loading tray, and that thereafter the loading trough by means of an associated control member is given a tilting movement which causes the shell to roll over sidewise into the loading tray.

A device for carrying out said procedure is mainly characterized in that a loading trough separate from the loading tray is supported coaxially on the elevating trunnions of the piece via a balancing device which, when the loading trough is empty, holds the side of the loading trough facing the loading table adjacent to and at the level of the table, that the loading trough is arranged to receive the shell when this is rolled down laterally from the table, and is made so that it can be tilted in its transverse direction in order to enable the shell to roll over laterally from the loading trough to the loading table.

Figure 1:
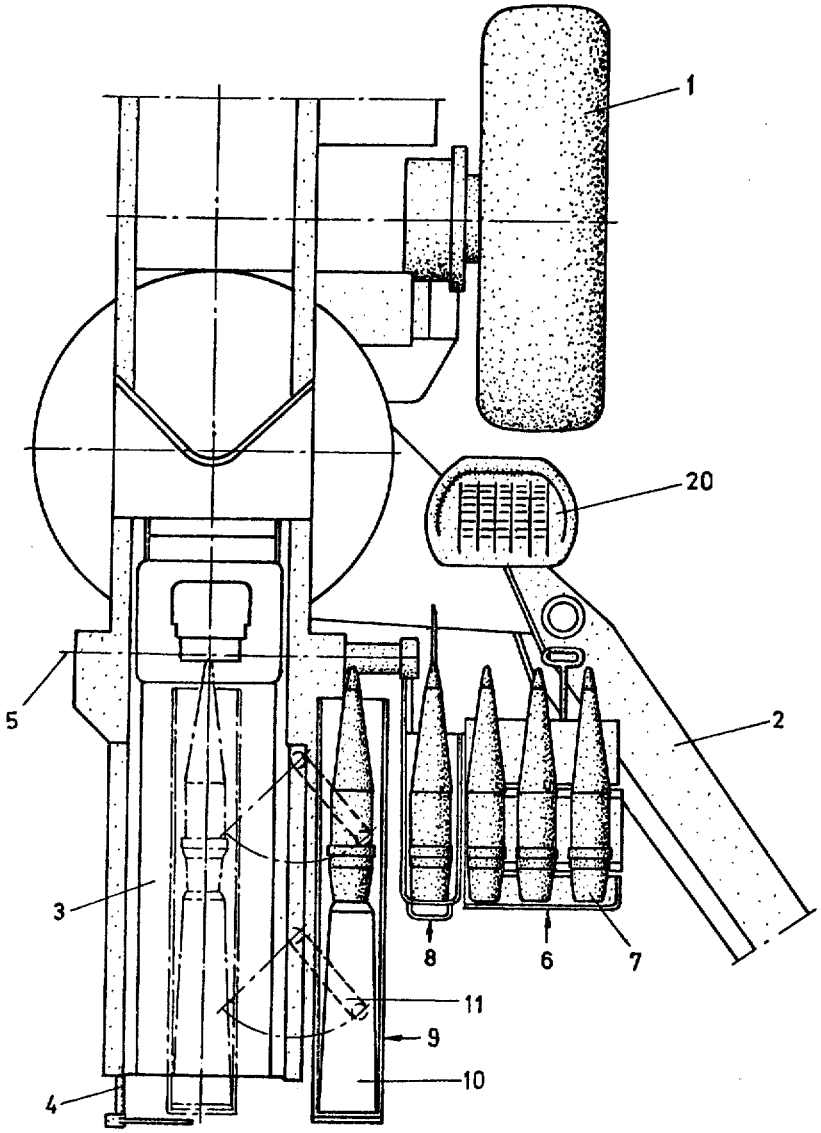
Figure 2:
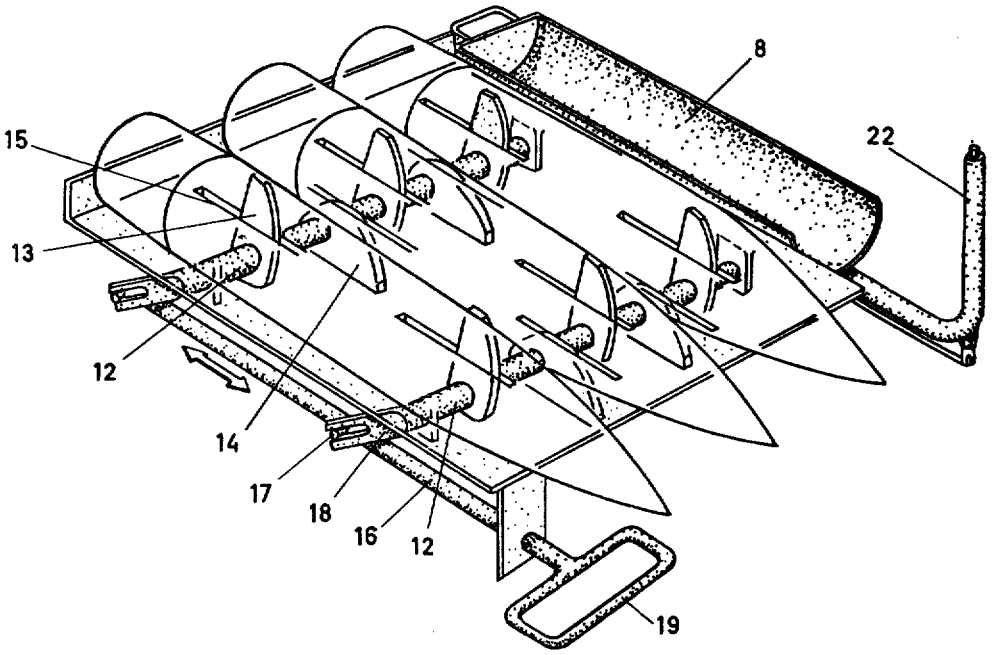
Figure 3:
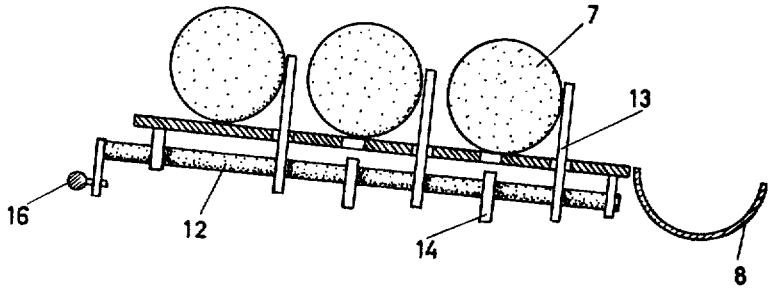
Figure 4:
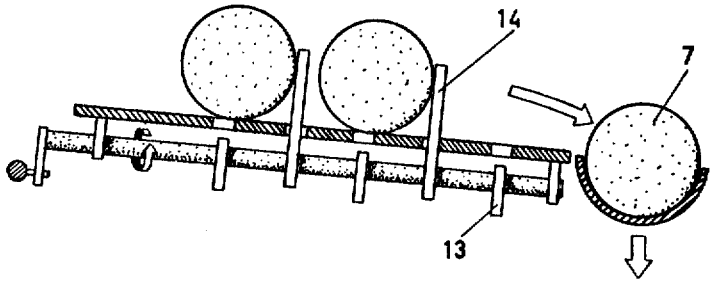
Figure 5:
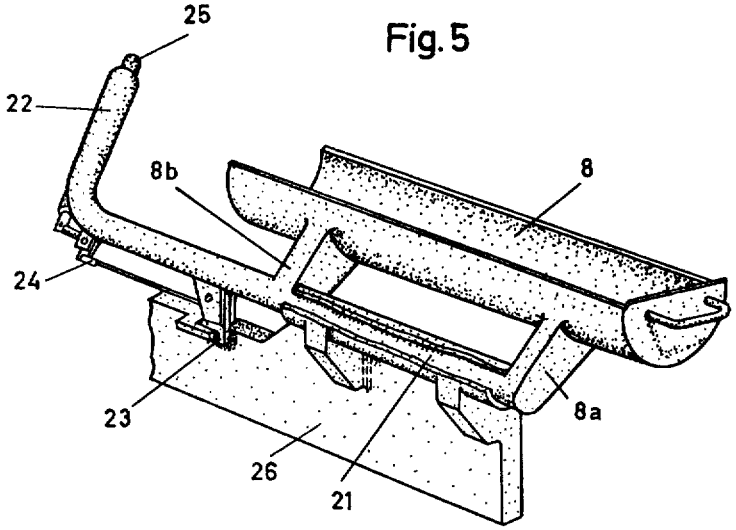
Figure 6:
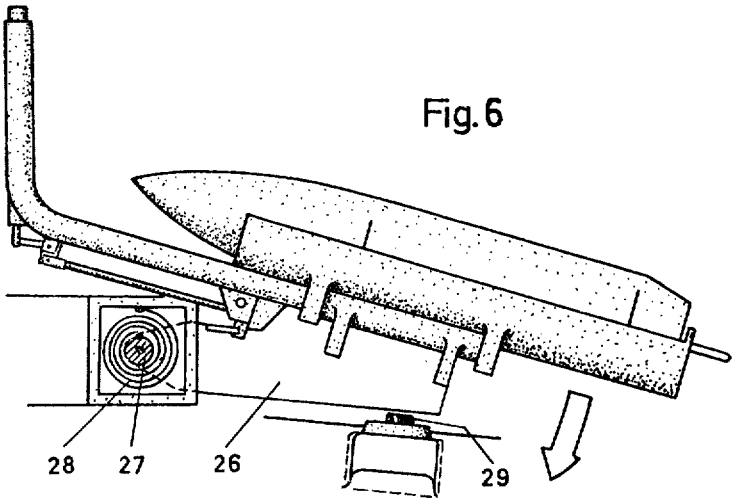

The loading device according to the invention is described in more detail with reference to the attached drawings, in which FIG. 1 shows a plan view, from above, of the loading device mounted on a field artillery piece, FIG. 2 is a view in perspective of the loading device with certain parts shown in an X-ray view, FIGS. 3 and 4 are cross sections of the device shown in FIG. 2, and FIGS. 5 and 6 are a perspective view and a side view, respectively, of the loading trough comprised in the loading device.

FIG. 1 shows the right, rear part of a field artillery piece on a wheeled carriage, comprising a wheel 1 and a carriage trail 2. The corresponding left wheel and carriage trail have been omitted for want of space. Other parts of the piece which are shown are the breech ring 3 with a hydraulically operated rammer 4. The center line of the elevating trunnions is designated 5. The loading device is placed at the right side of the breech ring 3, and comprises a loading table 6 on which, as illustrated, three shells 7 have been placed, a loading trough 8 having a semicircular cross section with a shell thereon, and a loading tray 9 carrying both one shell at the forward end of the tray and one cartridge case 10 at the rearward end of the tray, i.e. a complete round. The loading tray 9 is provided with parallelogram suspension consisting of two swinging arms 11 supported at the right beam of the cradle. The loading tray 9 thereby participates in the elevating movement of the cradle around the axis 5, and thus always has an inclination corresponding to the angle of elevation. With the aid of the swinging arms 11, the loading tray 9 can be displaced from the loading position shown in solid lines to the ramming position shown in dash lines, and the displacement of the loading tray between these positions is achieved by means of well-known hydraulic operating members, not shown.

The loading table 6, the design of which is shown more clearly in FIGS. 2–4, constitutes a supporting surface for three shells. It consists of a plate which is generally horizontal, seen viewed in the longitudinal direction of the gun, and which is provided with a device for feeding the shells one step at a time, as will be described in more detail in the following. In order to facilitate the feeding of the shells, the loading table is inclined approx. 10° towards the loading trough 8.

The feeding device comprises two shafts 12 (see FIGS. 2 and 3), which are rotatably supported under the loading table 6. Each shaft 12 is provided with a first series of cams 13 and a second series of cams 14. The second cams 14 are displaced at a 90° angle in relation to the first cams 13. The loading table is provided with slots 15, corresponding to the cams 13, 14. The shafts 12 can be rotated by means of a control rod 16, which is provided with pins 17, which coact with levers 18, provided with slots and arranged on the shafts 12. The control rod 16 is provided with a handle 19, which by means of the feeding device can be operated by a loader, who has his position on a seat 20 (FIG. 1), as will be described in the following.

The loading trough 8, which is shown in FIGS. 5 and 6, is rotatably supported via fastening arms 8*a*, 8*b*, on a shaft 21, which is extended to form a handle 22. The turning movement of the loading trough is locked by means of a locking device 23, which via an actuating mechanism 24 can be controlled by means of a push button 25 placed at the end of the handle 22. The loading trough is supported on a pendulum arm 26, which is rotatable around a support 27, which is coaxial with the trunnion center 5 of the piece (FIG. 1). The pendulum arm 26 is spring-actuated by a spring 28, which is is arranged that the loading trough 8, when empty, assumes the position shown in FIGS. 2-4 at the level of the loading table 6, and when loaded with a shell swings down to the position shown in FIG. 5, where the movement of the arm 26 is halted by a stop in the form of a rubber pad 29. The pad 29 is arranged on the elevating mass of the piece, and thus the loading trough is always stopped in the correct position in relation to the loading tray 9, regardless of the angle of elevation of the piece. The loading trough is then arranged in such a way in relation to the loading tray that when the tilting movement is carried out by means of said handle 22 it will assume a position adjacent to the loading tray 9 so that the shell placed in the loading trough 8 will be rolled over laterally into the loading tray 9.

The loading device described above functions in the following way.

When the handle 19 is pulled out to the position shown in FIG. 2, the cams 13 are turned down, at the same time as the cams 14 are turned up. The shell located nearest the loading trough 8 then falls down into the trough, while the other two shells are stopped in an intermediate position by the cams 14 (FIG. 4). The handle 19 is thereafter pushed back, and the cam 13, 14, return to the positions shown in FIG. 3, and the shells on the loading table 6 roll down until they are stopped by the cams 13. Thereafter, a further shell can be placed on the loading table 6.

When a shell 7 rolls down into the loading trough 8, as shown in FIG. 4, trough 8 swings down, under the influence of the weight of the shell, until it is stopped by the pad 29 at the level of the loading tray, on which a cartridge case 10 has been placed. The cartridge cases are loaded onto the loading tray 9 manually by a second loader.

The loader on the seat 20 thereafter releases the catch 23 by pushing the button 25, and with the aid of the handle 22 turns the loading trough 8 around the shaft 21, so that the shell is tipped over into the loading tray 9. The loading trough is turned up again through the action of the spring 28, and is turned back by the loader to the starting position and is blocked by means of the catch 23. The loading tray is thereafter ready to receive a new shell from the loading table 6.

As soon as the shell has been tipped over from the loading trough 8 to the loading tray 9, and a shell together with a cartridge case 10 has been placed therein, the loading tray with the complete round is swung to the ramming position, as shown by the dash lines in FIG. 1. The rammer 4 is activated and rams the round, after which the empty loading tray 9 returns to the starting position. The procedure described above can thereafter be repeated.

The use of the loading device described above facilitates the manual loading work considerably. The endurance of the crew is thereby increased to such a high degree that there will be factors other than the endurance of the personnel that will determine the capability of the artillery piece of maintaining firing.

The invention is not limited to the embodiment shown above as an example, but can also be subject to modifications within the scope of the following claims.

I claim:

1. A device for loading an artillery piece, particularly a heavy artillery piece, comprising a loading tray connected to the elevating mass of the artillery piece and mounted at the rear end of said artillery piece directly adjacent one side of said elevating mass for selective displacement between a loading position and a ramming position, an elongated loading trough separate from said loading tray mounted along the side of said loading tray which is positioned outwards of said elevating mass, a separate generally horizontal loading table mounted along the side of said loading trough which is positioned outwards of said loading tray, the forward ends of said trough, tray, and table being generally in alignment with one another, the rearward ends of said trough and table also being generally in alignment with one another, said loading tray being significantly longer than said trough and table whereby said tray defines a forward portion for receiving a shell and an integral rearward portion extending rearwardly of the aligned rearward loads of said trough and table for receiving a cartridge case, said loading table having selectively releasable latching means for maintaining and supporting a plurality of shells in side-by-side relation to one another in a generally horizontal plane, said generally horizontal table being slightly inclined toward said trough, means for supporting said trough coaxially on the elevating trunnions of the artillery piece for selectively pivotal motion about an axis extending in a direction transverse to the direction of elongation of said trough and located forward of the generally aligned forward ends of said trough, tray, and table, said trough supporting means including a balancing device which is operative, when the trough is empty, to hold the trough at a starting position wherein the side of the trough outwards of said loading tray and adjacent to the loading table is substantially level with the lowermost edge of said inclined table, said trough support means being arranged, when a shell is placed in said tray, to cause the weight of the shell to counteract the balancing device and to effect a pivotal motion of said trough about said axis in the lateral region between said table and the forward portion of said tray thereby to cause the trough to assume an inclination in its direction of elongation which corresponds to the inclination of said loading tray, means for selectively releasing said latching means to cause a shell to roll along said generally horizontal plane downwardly from said table into said trough when said trough is empty thereby to effect said pivotal motion of said trough, means for laterally tilting said trough about its axis of elongation when a shell is in said trough thereby to roll said shell laterally out of the side of said trough which is adjacent to said tray and onto said forward portion of said loading tray when said tray is in its loading position, and means for thereafter moving said loading tray from its loading position to its ramming position.

2. A device according to claim 1 wherein the loading trough has a cross section in the form of a semicircle, the loading trough being fastened to a rotatably supported shaft via fastening arms which extend between said shaft and the envelope surface of the loading trough.

3. A device according to claim 2, wherein said shaft has one end bent to serve as a handle which extends substantially at right angles to the other parts of the shaft, the loading trough being so arranged on said fastening arms that the lateral tilting movement of said trough is achieved by turning the shaft by means of the handle.

4. The device of claim 1 including spring means for pivotally returning said trough to its starting position after a shell has been rolled out of said trough.

5. The device of claim 1 including stop means on the elevating mass of the artillery position for limiting the pivotal motion of said trough.

6. The device of claim 1 wherein said means for selectively releasing said latching means is manually operative.

7. The device of claim 1 wherein said means for laterally tilting said trough comprises a manually operative handle.

* * * * *